US007077237B1

(12) United States Patent
Haake

(10) Patent No.: US 7,077,237 B1
(45) Date of Patent: Jul. 18, 2006

(54) CHAIN RAILING SYSTEM FOR SCAFFOLDING

(76) Inventor: Dan M. Haake, 18955 Quivira Rd., Springhill, KS (US) 66083

( * ) Notice: Subject to any disclaimer, the term of this patent is extended or adjusted under 35 U.S.C. 154(b) by 122 days.

(21) Appl. No.: 10/946,057

(22) Filed: Sep. 21, 2004

(51) Int. Cl.
*E04G 5/14* (2006.01)
*E04H 17/24* (2006.01)

(52) U.S. Cl. ..... 182/113; 256/59

(58) Field of Classification Search ..... 182/113, 182/112, 106, 150, 82, 45; 52/DIG. 12, 736.1, 52/698, 651.11, 703, 653.2, 73; 256/59, 256/32, 35, 1, 65; 404/6, 9, 12
See application file for complete search history.

(56) References Cited

U.S. PATENT DOCUMENTS

| | | | | | |
|---|---|---|---|---|---|
| 340,292 | A * | 4/1886 | Cox | 256/56 |
| 632,585 | A * | 9/1899 | Parker | 256/56 |
| 847,141 | A * | 3/1907 | Wilson | 52/736.1 |
| 2,677,530 | A * | 5/1954 | Lauffenburger | 52/736.1 |
| 2,906,507 | A * | 9/1959 | Hodson | 256/1 |
| 2,935,304 | A * | 5/1960 | Hewson | 256/48 |
| 3,082,843 | A | 3/1963 | Leonard | |
| 3,270,997 | A | 9/1966 | Gethmann | |
| 3,752,262 | A | 8/1973 | Helms | |
| 3,891,189 | A * | 6/1975 | Russo | 256/1 |
| 4,129,197 | A | 12/1978 | Preston | |
| 4,401,186 | A | 8/1983 | Dobersch | |
| 4,984,654 | A | 1/1991 | Anderson | |
| 5,154,256 | A | 10/1992 | Wood | |
| 5,829,550 | A | 11/1998 | Cornish | |
| 6,006,862 | A | 12/1999 | Palmer | |
| 6,131,698 | A | 10/2000 | Reyland | |
| 6,517,280 | B1 * | 2/2003 | Carter | 404/6 |
| 2003/0047382 | A1 | 3/2003 | Panacci | |

* cited by examiner

*Primary Examiner*—Hugh B. Thompson, II
(74) *Attorney, Agent, or Firm*—Kenneth W. Iles

(57) ABSTRACT

A lock utilizing a retractable pin is used to capture one link of a chain to fasten the chain to one or more vertical uprights. The user depresses a bolt that protrudes from the hollow vertical stake member to overcome spring tension and slide a hardened pin away from a slot in the stake and an aligned slot in the lock housing, then inserts a selected link of a chain and releases the bolt, which slides the pin through the chain link and beyond the slots. The pin reciprocates within a tight-fitting bore in the lock housing, increasing lateral strength of the locking system. The resulting railing can cover any length and a number of spaced parallel railings can be strung between spaced vertical uprights.

15 Claims, 5 Drawing Sheets

CHAIN RAILING SYSTEM FOR SCAFFOLDING

CROSS-REFERENCE TO RELATED APPLICATIONS

Not Applicable.

STATEMENT REGARDING FEDERALLY SPONSORED RESEARCH OR DEVELOPMENT

Not applicable.

REFERENCE TO A SEQUENCE LISTING

Not Applicable.

BACKGROUND OF THE INVENTION

The present invention is related to an apparatus for providing a railing for a scaffold. More particularly, the present invention is related to an apparatus for providing a flexible strand railing, such as a chain, cable, webbing or the like, for a scaffold, a livestock fence, a crowd control barrier or the like.

Federal regulations require that a railing be provided for the outer perimeter of a scaffold that is more than 2 meters (6 ft.) high. Most scaffolding includes horizontal arms that project outwardly from a scaffold form or a wall which it includes a socket at their outer ends for receiving a vertical member, commonly a stake or post. Conventionally, lumber uprights, such as 2"×4" timbers of appropriate length are installed into the sockets and other 2"×4" members are horizontally disposed between the upright members and are nailed to them. In most cases, contractors would like to reuse this lumber in making railings for scaffolding installed at different job sites. In practice, however, such timbers are usually lost to other uses before they can be reused on another job site.

Frequently, after the scaffolding has been disassembled, transported to another job site and erection of the scaffolding has begun, the workers learn that the timbers used to form the railing are either missing or have been cut into pieces that make them unsuitable for use as railing. Then workers must leave the job site and go to a lumberyard to purchase replacement timbers. This time-consuming departure from the work of erecting a scaffolding may spell the difference between profit or loss on a particular job.

Efforts to develop reusable railings for scaffolds have led to several United States patents or published patent applications. For example, United States Patent Application Publication Number US 2003/0047382, disclosing an invention by Panacci and published on Mar. 13, 2003, discloses a Scaffolding Safety Apparatus and Method of Installation including a horizontal safety rail secured to vertical upright members. The horizontal safety rail may be connected to the upright members by a U-shaped hook having one end fastened into an aperture in a pinched and flattened end of the horizontal rail member and the other end fastened around the upright member. A spring-loaded U-shaped bracket urging the bracket into contact with the vertical post is used to mount the horizontal railings onto the vertical members. Because the railing could become disconnected from the vertical post, a chain can be used to secure a horizontal member by wrapping it around the member and securing it with a hook with the chain being secured to a channel bracket. This system requires that the horizontal railing members be an exact certain length in order to be connected to the vertical supports for the railing and presumably different lengths of railing would be needed for different types of scaffolds. Further, the hooks used to connect the horizontal railing members to the corresponding vertical support may become disconnected, leaving workers unprotected. U.S. Pat. No. 5,154,256, issued to Wood on Oct. 13, 1992 and involves exactly the same shortcomings.

Similarly, U.S. Pat. No. 6,131,698, issued to Reyland on Oct. 17, 2000, discloses a scaffold railing system that requires the horizontal rail members having an outwardly projecting pin that must be aligned with a vertical support member and that must fit into a U-shaped bracket on each of the principal scaffolding vertical support members. This system requires workers to align a number of different pieces and to assemble them, requiring substantial labor and specific exact dimensions between vertical and horizontal scaffold railing members, which may be difficult to achieve in the filed.

U.S. Pat. No. 6,006,862, issued to Palmer on Dec. 28, 1999, also suffers from these exact same disadvantages, as does the U.S. Pat. No. 3,752,262, issued to Helms on Aug. 14, 1973, which discloses a bracket for holding horizontal railing members. In this case, not only must the horizontal railing members be out an exact specific length, they must include a hole drilled all the way through that can be aligned with holes in the retaining brackets, a precision that may not always be easy to achieve in the field.

Therefore, a exists for a railing system for a scaffold that does not require horizontal members of any particular length; that can be reused readily and that has no other convenient use; that does not require working with precise tolerances for a suitable installation; and that can be easily and conveniently assembled and disassembled and stored or transported to a different job site.

BRIEF SUMMARY OF THE INVENTION

Accordingly, it is a primary object of the present invention to provide a railing system for a scaffold that does not require horizontal members of any particular length.

It is another object of the present invention to provide a railing system for a scaffold that can be reused readily and that has no other convenient use.

It is another object of the present invention to provide a railing system for a scaffold that does not require working with precise tolerances for suitable installation.

It is another object of the present intention to provide a railing system for a scaffold that can be easily and conveniently assembled and disassembled and stored or transported to a different job site.

These objects are achieved by providing a railing system that includes spaced vertical members with horizontal railing members consisting of a flexible member, such as a linked chain, a cable or webbing which one link of a linked chain is placed into a slot in each vertical number and secured in place by a hardened steel pin in a locking bolt mechanism. The locking bolt is basically a bolt having a flattened portion to accommodate the selected chain link and that carries an outwardly projecting ear that includes a forwardly projecting horizontally oriented hardened steel pin. The locking bolt is seated in a housing that allows the user to push on one end of the locking bolt to overcome a spring bias and move the locking pin rearward away from the slot in the housing. The user inserts the selected chain link into the slot and releases the locking bolt, which then slides forward so that the locking pin captures the selected chain link and slides past the slot, holding the chain link in place. Any individual link in a chain can be selected to be locked into the locking mechanism, allowing workers to quickly and easily install the railing without any measurements needed, since the chain railing can be fastened and locked into the vertical stakes at any location along its length. The locking pin reciprocates within a tight tolerance bore through the locking block, or housing that contains the locking mechanism, resulting in a lock that resists lateral forces on the pin extremely well. Lateral forces are generated by pulling on the chain railing, as when a worker or equipment falls against it. The selected and now locked chain length is readily removed from the vertical railing member by again pressing the locking bolt rearward, thereby clearing the chain link from the locking pin.

In another embodiment, a steel cable or cloth webbing member is gathered at periodic intervals and fastened into small loops by a crimped cable tie or the like and the outer end of the resulting loop is secured into the locking block in the vertical members as described above.

Because any particular link on the chain may be selected for locking into a vertical support member, the vertical support members do not need to be spaced apart at any particular intervals to use the system disclosed herein effectively. Further the vertical members, preferably made from tubular steel having a uniform square cross-section, with the locking mechanism fastened inside, have no other particular use and although the chain may have many uses it cannot substitute for a lumber in most applications and so the complete system will typically be available for future use on other job sites.

Other objects and advantages of the present invention will become apparent from the following description taken in connection with the accompanying drawings, wherein is set forth by way of illustration and example, the preferred embodiment of the present invention and the best mode currently known to the inventor for carrying out his invention.

DETAILED DESCRIPTION OF THE INVENTION

Figure 1:
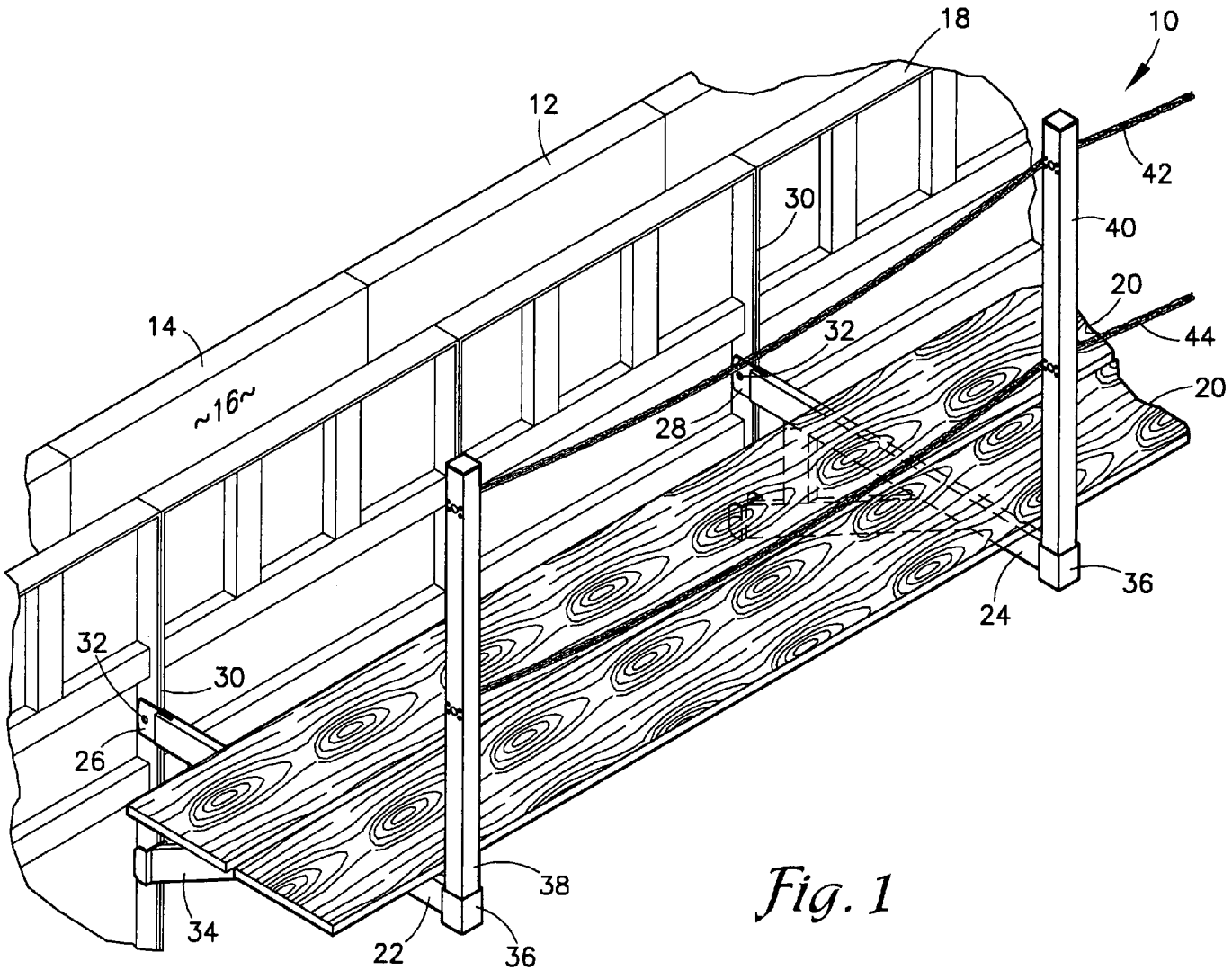
FIG. 1 is an isometric view of a foundation form system and scaffolding employing a chain railing system for scaffolding according to the present invention.

Referring to FIG. 1, there is shown a chain railing system for scaffolding 10 in use on a scaffolding. A wall form 12 for pouring a concrete a wall is assembled from sections forming a rear wall form 14 having a smooth inner surface 16 and an outer or front wall form 18 also having a smooth inner surface. Appropriate reinforcing bars and the like are inserted between the wall forms 14, 18 and the cavity and is filled with poured concrete to form a concrete wall. In the type of wall form illustrated, vertical sections are stacked one upon the other and fastened to each other and the form is built up vertically section by section. This task is typically preformed by workers standing on the scaffold planks 20, which are attached to the outer wall form 18 and which allow the workers to add the next higher vertical wall form sections and then to move the scaffolding up to the newly installed section, allowing the workers to install another vertical section of the wall forms.

Still referring to FIG. 1, the scaffold planks 20 are supported by the outwardly extending horizontal arms 22, 24, each of which includes a proximal end 26, 28, respectively, which is fastened to a side rail 30 of the wall form by a pin 32 and is further supported by a separate depending reinforcing strut 34 that is connected to each arm 22, 24 and butts against the vertical side rail 30. Typically, the scaffold planks 20 are simply laid across the outwardly extending horizontal arms 22, 24. A number of more or less equally spaced arms 22, 24 are used to cover the length of the form being built.

Still referring to FIG. 1, the outer end of the arm 22 includes a stake socket 36 for receiving and retaining an end of a vertical stake 38 and the outer end of the arm 24 includes an identical stake socket 36 for receiving and retaining an end of a vertical stake 40. The vertical stakes 38, 40 are both tubular stakes having a uniform square cross-section when the sections are taken perpendicular to the longitudinal central line of the stakes. Stakes having other cross section shapes, for example circular, could also be used and the body of the locking block 68 (FIG. 2), which is secured to each vertical stake 38, 40 preferably inside each vertical stake 38, 40 would have a different outer shape. The stakes 38, 40 may be solid, such as timbers, with cavities formed in them to receive and retain the locking block 68 in the same fashion shown in the drawings, with suitable openings to receive the chain and to expose a button end of the reciprocating lock mechanism, but the stakes 38, 40 are preferably the square cross section tubular stakes illustrated and are preferably steel. The locking block 68 may be fixed to an outer surface of each stake 38, 40 by web bands, screws or the like, but securing the locking block inside the stakes 38, 40 is superior because the mechanism is better protected from damage and the resulting stakes can be stacked and bundled more readily. Any number of stakes can be used along any particular wall so as to provide stakes at the intervals necessary for supporting the anticipated loads on the stakes 38, 40. An upper chain railing 42 and a lower chain railing 44 are installed along the stakes 38, 40 and additional chain railings can be installed along the same run of scaffolding if desired, preferably generally horizontal and generally parallel to the upper and lower chain railings 42, 44 shown here. The chain railing 42, 44 may be replaced by any suitable flexible strand strung between vertical stakes, such as a cable, rope or webbing and is readily fastened to or removed from the stakes 38, 40.

Figure 2:
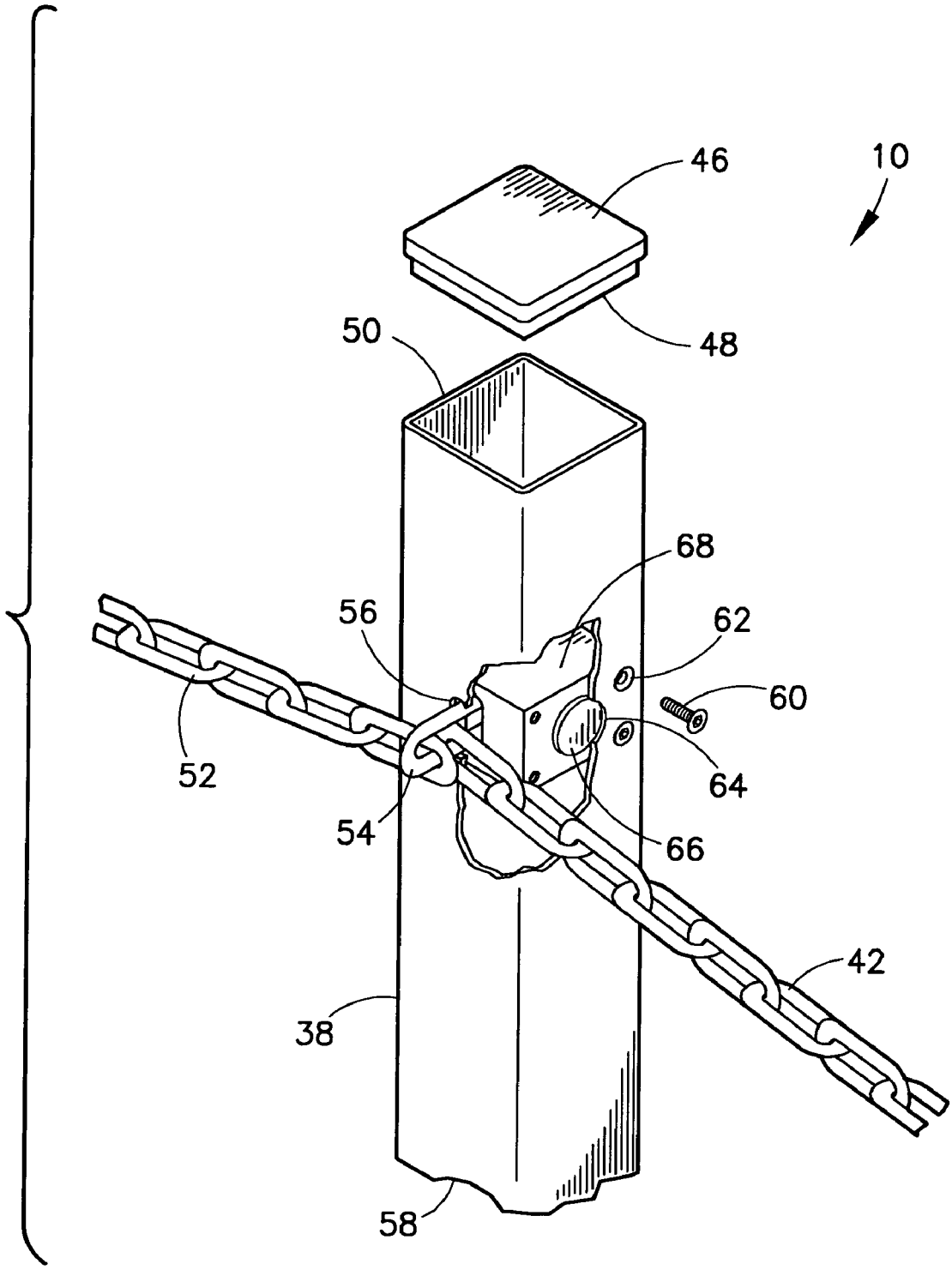
FIG. 2 is a fragmentary isometric view of a stake or post for holding the chain railing of the chain railing system of FIG. 1 partially cut away to show the locking block used to secure a link of the chain railing.

Referring to FIG. 2, the stake 38, which is identical to the stake 40 and all the stakes used in the chain railing system for scaffolding 10, includes an end cap 46 having a depending lip portion 48 about its perimeter, which seats into the matching opening 50 in the top end of the stake 38. The end cap 46 can be inserted into and removed from the top of the stake 38 and seals out water and debris when installed, while allowing access to the interior of the stake 38 for servicing and so forth.

Still referring to FIG. 2, the chain railing 42 consists of a series of consecutive links 52 any particular desired length, and any particular desired link, such as the locking link 54, is pulled sideways generally perpendicular to the general run of the chain 42 and is inserted into the slot 56 in the rear side wall 58 of the stake 38, where it is captured and locked into place by a locking block 68 mechanism described below. The stakes 38, 40 may be arranged so that the slot 56 faces any desired direction, but usually it is best if the slots 56 face inward, that is, toward the workers standing on the scaffold planks 20. Four machine screws 60 are inserted into four apertures 62, which are arranged in a square pattern surrounding a large circular aperture 64, and are screwed into matching bores in the locking block 68, securing it into position within the stake 38. The large circular aperture 64 provides access to the actuating bolt 66 of the locking block 68. The locking block 68 securely holds the chain link 54 in place against the stake 38 while enabling the chain link 54 to be removed from the locking block 68 easily and without tools.

Figure 3:
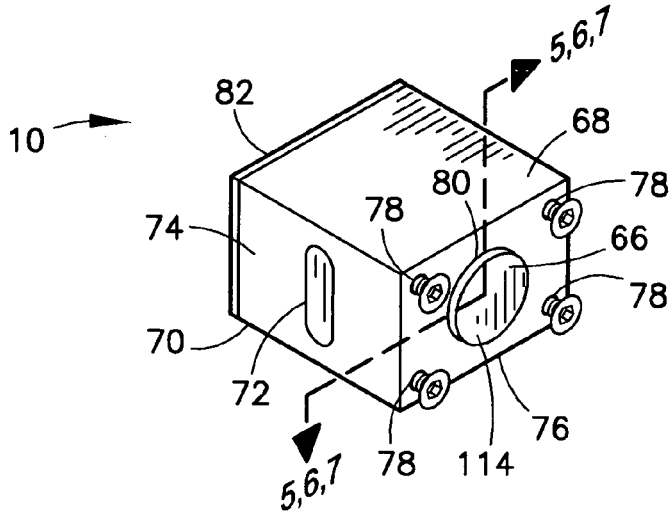
FIG. 3 is an isometric view of a locking block for use with the chain a railing system for scaffolding of FIG. 1.

Referring to FIG. 3, the locking block 68 includes a body 70, preferably machined from a solid block of steel, having a vertically oriented slot cut into a left-hand face 74 for receiving the locking link 54. On the front face 76 of the locking block 68 are four threaded bores 78 for receiving the machine screws 60, with the four threaded bores arranged in the same pattern as the apertures 62 on the stake 38. In the center of the square pattern formed by the bores 78 is a central aperture 80 through which the actuating bolt 66 protrudes. A backing plate 82 forms the rear face of the locking block 68 and is fastened there by two screws.

Figure 4:
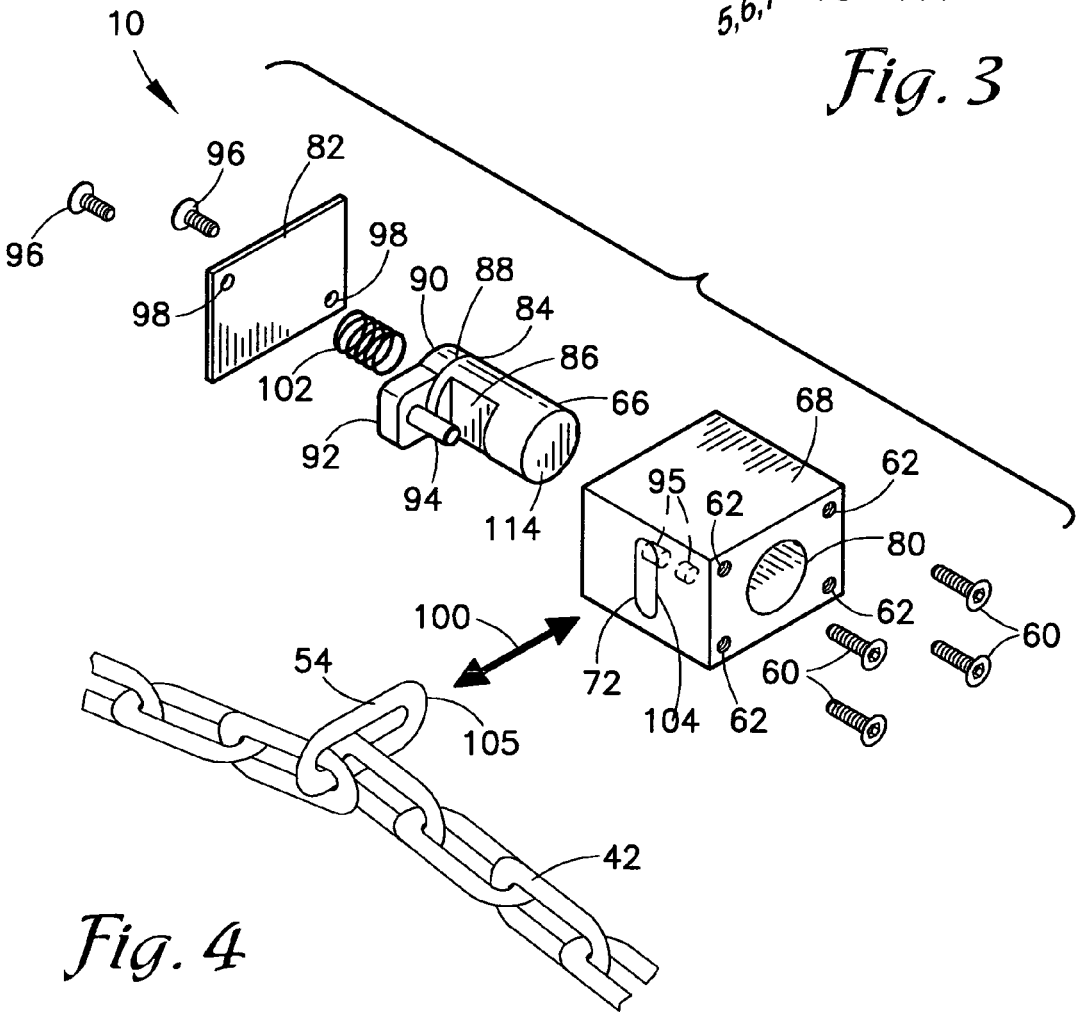
FIG. 4 is an isometric exploded view of the locking block of FIG. 3, and also illustrating the insertion of a link of the chain railing into the locking block.
Figure 9:
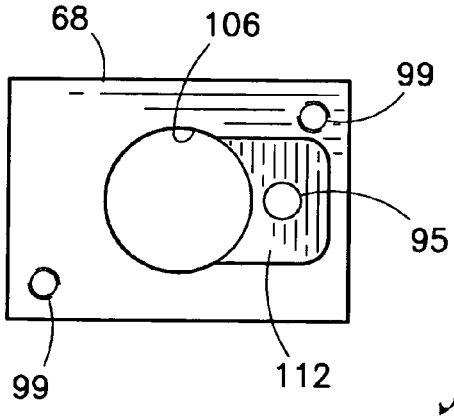
FIG. 9 is a rear view of a locking block for use in the chain railing system for scaffolding of FIG. 1 with the backing plate and locking bolt removed.

Referring to FIGS. 4, 9 the actuating bolt 66 includes a cylindrical plunger portion 84 having a flat land portion 86 cut into it on an outer face adjacent to its distal end 88. At the distal end lies a flange portion 90 having an outwardly projecting ear portion 92 that projects outwardly away from the flat land portion 86 and which carries a perpendicularly oriented outwardly projecting cylindrical pin 94, which is preferably a hardened steel pin, which is parallel to and spaced apart from and is adjacent to the flat land portion 86 of the cylindrical plunger portion 84. The pin 94 is conveniently press fitted into an aperture on the ear and flange portion 90 may conveniently include an aperture that is press fitted onto a reduced diameter end portion of the bolt itself. The cylindrical pin 94 is seated in a bore 95 in the locking block 68, which is a tightly fitting bore and which embraces the entire length of the cylindrical pin 94 when the pin 94 is in the locked, i.e., spring-loaded equilibrium position, except for the very end that is pressure fitted into the ear 92. The actuating bolt 66 is seated within a cavity and the locking block 68 and held in place by the backing plate 82, which is secured by the two machine screws 96 which penetrate the matching apertures 98 and go into the aligned threaded bores 99 (FIG. 9) in the locking block 68. The locking link 54 of the chain railing 42 is hooked over the cylindrical pin 94 to secure the chain 42 or the chain 44 to the stake 38 by inserting the locking link 54 through the slot 72 in the locking block 68 and removed by pulling the locking link 54 from the locking block 68, along the directions shown by the double-headed arrow 100. A coil compression spring 102 presses against the rear surface of the actuating ball 66 in the front surface of the backing plate 82 to urge the locking ball 66 forward, that is, toward the front face of the locking block 68, which pushes the cylindrical pin 94 passed the front edge 104 of the slot 72, thereby locking the locking link 54 into place and ensuring that the locking link 54 cannot be withdrawn from the locking block 68 unintentionally. The flat land 86 is designed to receive and accommodate the end 105 of the locking link 54 of the chain 42.

Figure 5:
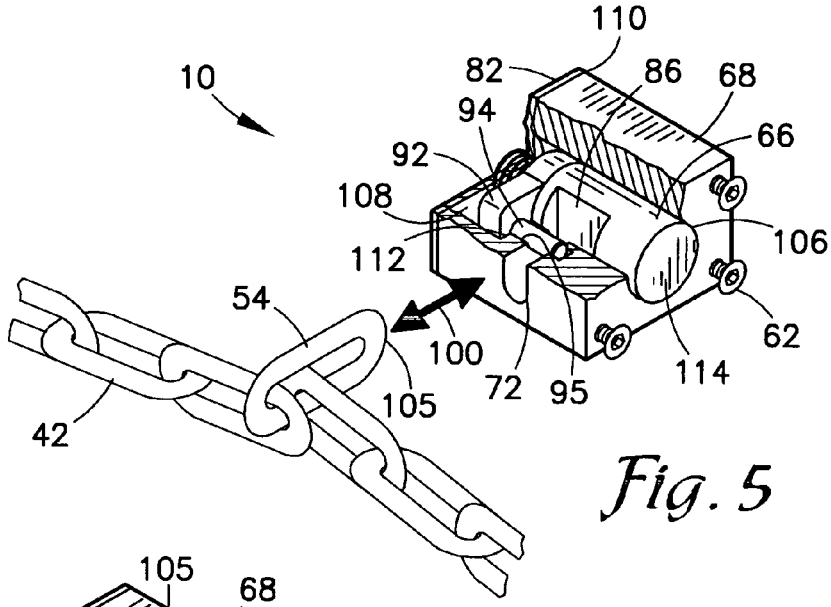
FIG. 5 is a partially sectional isometric view of the locking block of FIG. 3 taken along lines 5—5 of FIG. 3 showing the locking pin in the closed or locked or equilibrium position and the preparation of a link in the chain railing for insertion into the locking block.

Referring to FIG. 5, the actuating bolt 66 is seated in a cylindrical bore 106 for reciprocal movement in the locking block 68, within a substantially rectangular cavity 108 cut into the locking block adjacent to the rear face 110, which is closed by the backing plate 82, with the cavity projecting toward the left-hand face 74 of the body 70 and designed to accommodate the ear potion 92 of the flange portion 90. A front wall 112 in the cavity 108 serves as a stop that is engaged by the front surface of the ear portion 92 to retain the pin 94 in its equilibrium position, that is, its locked position, due to the urging of the coil compression spring 102, as shown in FIG. 5. The backing plate 82 closes the locking assembly and serves as a rear stop to limit the rearward movement of the actuating bolt 66.

Figure 6:
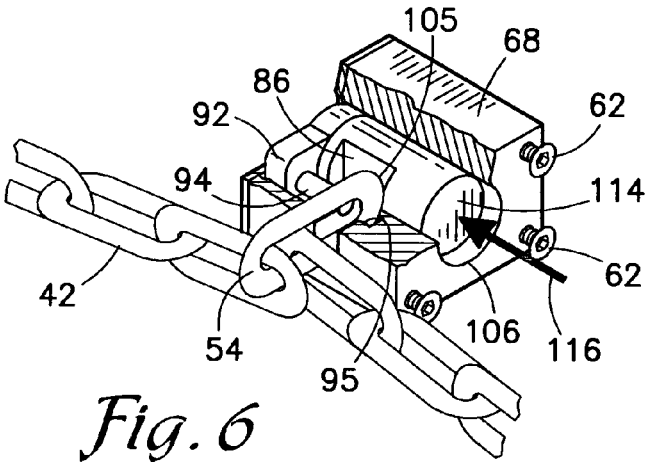
FIG. 6 is a partially sectional isometric view taken along lines 6—6 of FIG. 3 illustrating the insertion of a link of the chain railing into the locking block.
Figure 7:
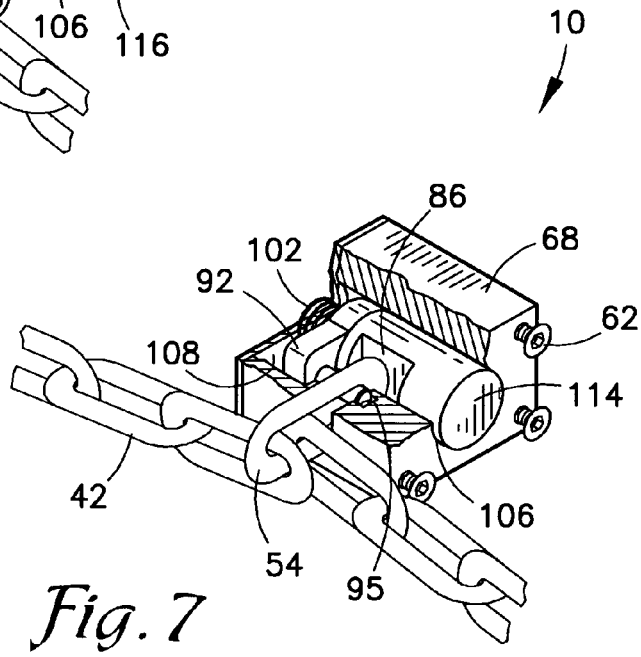
FIG. 7 is a partially sectional isometric view taken along lines 7—7 of FIG. 3 illustrating the chain railing installed and locked into position in the locking block.

Referring to FIG. 6, to release the actuating bolt 66 so that it can receive the locking link 54 of the chain railing 42, the user presses on the button end 114 of the locking bolt 66 in the direction of the arrow 116 and compresses the coil compression spring 102 until the rear surface of the flange 90 and ear 92 portions butt against the backing plate 82, thereby drawing the locking pin 94, which is behind the slot 56 in the stake 38, back from the slot 56 in the stake 38 and the aligned slot 72 in the locking block 68 and inserts the end 105 of the locking link 54 into the slots 56, 72, and then releases the button end 114, allowing the coil compression spring 102 to force the locking bolt 66 toward the front of the locking block 68, and simultaneously thrusting the locking pin 94 through the locking link 54 of the chain railing 42 and locking it into place. The locked position is shown in FIG. 7.

Figure 8:
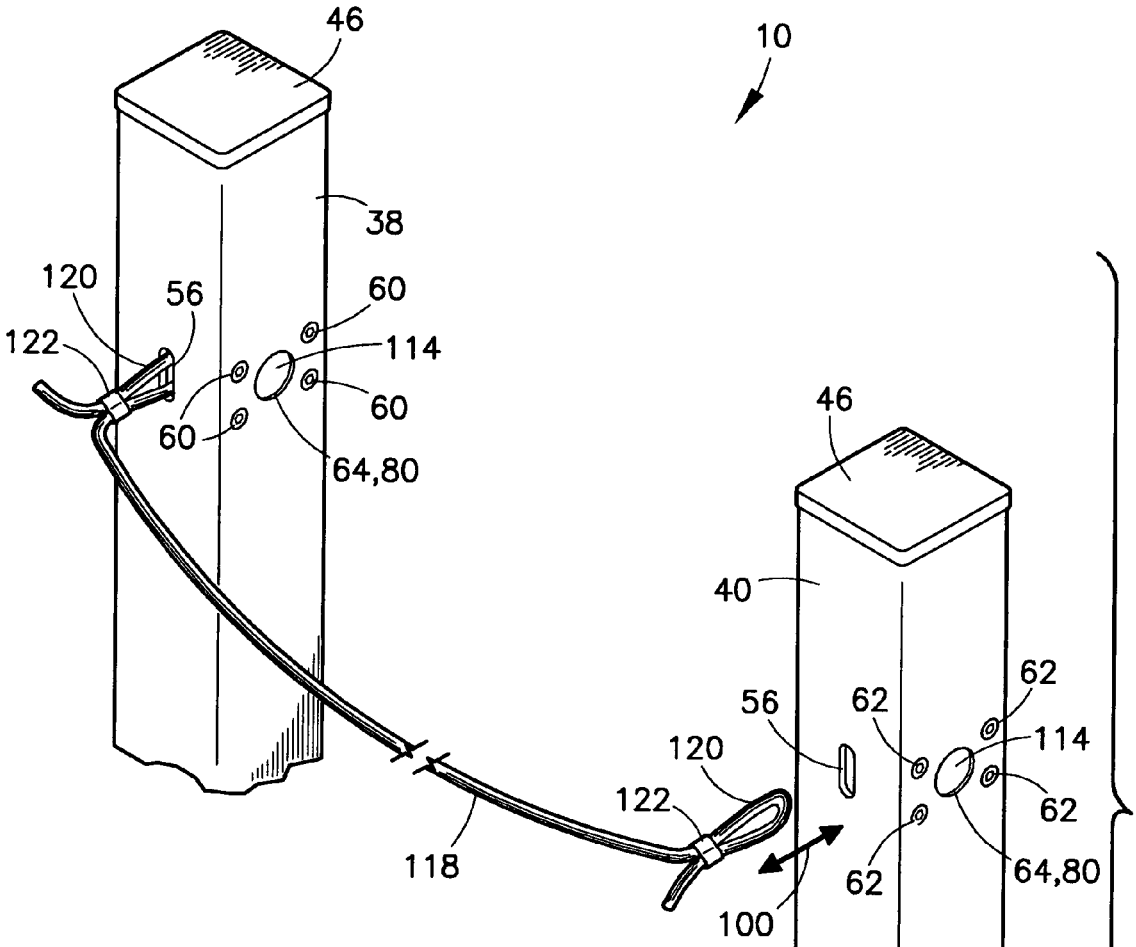
FIG. 8 is an isometric view of the chain railing system for scaffolding of FIG. 1 showing the chain railing system of FIG. 1 utilizing a cable railing in lieu of a chain railing.

Referring to FIG. 8, another type of line may be used in place of a chain 42, 44, such as the cable 118, which is gathered into the short loops 120 at intervals between stakes 38, 40, and are held in place by the crimped cable ties 122. Such cables are typically stronger and lighter than chains and are easier to store. Other types of railing may be used with the locking system described here.

While the present invention has been described in accordance with the preferred embodiments thereof, the description is for illustration only and should not be construed as limiting the scope of the invention. Various changes and modifications may be made by those skilled in the art without departing from the spirit and scope of the invention as defined by the following claims. For example, the upper chain railing 42 and the lower chain railing 44 are both attached to the vertical posts 38, 40 in identical fashion and any number of chain railings may be attached to the vertical stakes and any number of vertical stakes may be arranged to provide a chain railing system of any desired length. The dimensions of the locking block 68, the slot 56 and other components may be designed to accommodate two links 54 of the a chain so that one end of each of two separate chains can be attached in a single locking block 68, which may be particularly useful in constructing long railings. Further, a cable, rope, or webbing member is gathered at periodic intervals and small loops are formed by crimped cable ties or the like with the loops spaced closely enough together that the cable or webbing can be used with different scaffold or railing systems having different spacings between the vertical members. The locking system described herein may also be used in other applications such as roping off restricted areas, providing fencing for live stock and so forth. Further, any means for maintaining the stakes in an upright position may be used, such as driving them into the ground, anchoring them in receptacles filled with concrete, and so forth.

I claim:

1. A railing system comprising:

a. a plurality of spaced apart stakes, each said stake fixed in a generally upright position and each said stake further comprising a slot in each said stake;

b. at least one flexible strand strung between said stakes;

c. means for connecting said flexible strand to each said stake fixed to each said stake; and d. means for locking a portion of said flexible strand within said slot with said locking means further comprising a retractable pin seated in a locking block behind said slot.

2. A railing system in accordance with claim 1 wherein said strand further comprises a linked chain.

3. A railing system in accordance with claim 2 wherein said locking system further comprises capturing one link of said linked chain by inserting said retractable pin into said one link.

4. A railing system in accordance with claim 1 wherein said flexible strand further comprises a cable gathered to form loops secured with crimped cable ties and a plurality of said loops is formed and spaced apart at periodic intervals along the length of said flexible strand.

5. A railing system in accordance with claim 4 wherein said locking system further comprises capturing one said loop by inserting said retractable pin into said loop in each said stake.

6. A railing system in accordance with claim 1 wherein said strand connecting means further comprises a plurality of tubular stakes, each said tubular stake having at least one locking block fixed inside each said stake.

7. A railing system in accordance with claim 6 wherein said locking block further comprises an actuating bolt having a button end that protrudes through an aperture in each said tubular stake, with said actuating bolt seated in a cylindrical cavity in said locking block for reciprocal movement therein, said actuating bolt having a distal end that carries a protruding ear having said locking pin mounted thereon for reciprocal movement across a slot in each said stake and an aligned slot in said locking block and means for urging said actuating bolt into a locked position connected to said locking block and means for stopping the reciprocal movement of said actuating bolt.

8. A railing system comprising:

a. a plurality of spaced apart tubular stakes, each said tubular stake fixed in a generally upright position and each said tubular stake further comprising a slot in each said tubular stake;

b. at least one flexible strand strung between said tubular stakes;

c. means for connecting said flexible strand to each said stake fixed inside of each said tubular stake; and d. means for locking a portion of said flexible stand within said slot, wherein said locking means further comprises a retractable pin behind said slot, with said retractable pin fixed to an actuating bolt seated in cylindrical cavity in a locking block fixed inside each said tubular stake.

9. A railing system in accordance with claim 8 further comprising means for stopping said reciprocal movement of said retractable pin in both a forward and rearward movement.

10. A railing system in accordance with claim 8 further comprising means for retaining said retractable pin behind said slot when said retractable pin is subjected to lateral forces.

11. A railing system in accordance with claim 10 wherein said pin retaining means further comprises a bore in said locking bolt within which said retractable pin is seated.

12. A railing system in accordance with claim 11 further comprising means for urging said actuating bolt into a locking position wherein said flexible strand is captured by said retractable pin.

13. A railing system comprising:

a. a plurality of spaced apart tubular stakes, each said tubular stake fixed in a generally upright position;

b. at least one flexible strand strung between said tubular stakes and removably fastened to said tubular stakes; and c. at least one locking block fixed inside each said tubular stake, said locking block further comprising an actuating bolt having a button end that protrudes through an aperture in each said tubular stake, with said actuating bolt seated in a cylindrical cavity in said locking block for reciprocal movement therein, said actuating bolt having a distal end that carries a protruding ear having said locking pin mounted thereon for reciprocal movement across a slot in each said stake and an aligned slot in said locking block and means for urging said actuating bolt into a locked position connected to said locking block and means for stopping the reciprocal movement of said actuating bolt.

14. A railing system in accordance with claim 13 wherein said actuating bolt further comprises a flat land portion adjacent to said locking pin.

15. A railing system in accordance with claim 13 further comprising means for urging said locking pin into a locked equilibrium position.

* * * * *